United States Patent [19]

McConaghy, Jr.

[11] 4,176,046

[45] Nov. 27, 1979

[54] PROCESS FOR UTILIZING PETROLEUM RESIDUUM

[75] Inventor: James R. McConaghy, Jr., Ponca City, Okla.

[73] Assignee: Conoco, Inc., Ponca City, Okla.

[21] Appl. No.: 955,278

[22] Filed: Oct. 26, 1978

[51] Int. Cl.[2] ..... C10G 9/14; C10G 37/02

[52] U.S. Cl. ..... 208/50; 208/56

[58] Field of Search ..... 208/50, 56, 131

[56] References Cited

U.S. PATENT DOCUMENTS

| | | | |
|---|---|---|---|
| 2,703,780 | 3/1955 | Voorhies | 208/214 |
| 2,772,221 | 11/1956 | Stewart et al. | 208/56 |
| 2,775,549 | 12/1956 | Shea | 208/106 |
| 2,922,755 | 1/1960 | Hackley | 208/106 |
| 2,953,513 | 9/1960 | Langer | 208/56 |
| 3,238,118 | 3/1966 | Axey et al. | 208/59 |
| 4,090,947 | 5/1978 | Satchell | 208/50 |

*Primary Examiner*—Herbert Levine

*Attorney, Agent, or Firm*—Richard W. Collins

[57] ABSTRACT

A petroleum refinery vacuum residuum stream is subjected to hydrogen donor diluent cracking, the liquid cracking effluent is hydrodesulfurized, the hydrodesulfurizer effluent is fractionated, and the fractionator bottoms stream is fed to a delayed coker where premium type delayed coke is produced. The gas oil boiling range fraction from the fractionator is utilized as the donor diluent in the cracking step.

4 Claims, 1 Drawing Figure

PROCESS FOR UTILIZING PETROLEUM RESIDUUM

BACKGROUND OF THE INVENTION

1. Field of the Invention

This invention relates to a process of making more valuable products from a low value petroleum refinery stream such as a vacuum residuum, and more particularly relates to a novel process for producing premium delayed coke from a petroleum residuum feedstock.

2. Description of the Prior Art

There are several processes available in the petroleum refining art for upgrading heavy, low value petroleum residual oils. Typical of such low value residual oils is the bottoms fraction from a vacuum distillation tower. Such vacuum distillation towers generally are used to further fractionate virgin atmospheric reduced crude oils. The bottoms fraction from such vacuum distillation columns, referred to herein as resid, generally includes all the material boiling above a selected temperature, usually at least 480° C., and often as high as 565° C. In the past, vacuum residuum streams have presented serious disposal problems, as it has been difficult to convert such streams to more valuable products in an economic manner. One method of disposing of resid has been to use the stream as feedstock to a fluid bed or delayed coking unit. The resulting coke generally has only fuel value. Fluid bed and delayed coking processes for converting vacuum residuum into coke are well known in the petroleum refining industry, and many commercial units utilizing these processes exist.

Delayed coking of vacuum residuum generally produces a coke with a linear coefficient of thermal expansion (CTE) greater than $20\times10^{-7}$° C. The CTE of the coke is a measure of its suitability for use in the manufacture of electrodes for electric arc steel furnaces. The lower CTE cokes produce more thermally stable electrodes. Coke which is suitable for manufacture of electrodes for steel furnaces is generally designated as premium coke. Premium coke differs both in appearance and in physical properties from regular coke. The distinction between regular coke and premium coke was first described in U.S. Pat. No. 2,775,549 to Shea, although the needle coke described in that patent would not be acceptable in the present premium coke market. The manufacture and properties of premium coke are further described in U.S. Pat. No. 2,922,755 to Hackley.

The CTE value required for a coke to be designated premium coke is not precisely defined, and there are many specifications other than CTE which must be met in order for a coke to be designated premium coke. Nevertheless, the most important specification, and the one most difficult to achieve in manufacture, is a suitably low CTE. For example, the manufacture of 61 cm diameter electrodes requires CTE values of less than $5\times10^{-7}$° C., and the manufacture of 41 cm diameter electrodes generally requires a coke having a CTE of less than $8\times10^{-7}$° C. Delayed coking of vacuum residuum from most crudes produces a coke with a CTE of greater than $20\times10^{-7}$° C., and such cokes, designated regular grade cokes, are not capable of producing a satisfactory large diameter graphite electrode for use in electric arc steel furnaces.

As used herein, the term "premium coke" is used to define a coke produced by delayed coking, which, when graphitized according to known procedures, has a linear coefficient of thermal expansion of less than $80\times10^{-7}$° C. The process conditions for operating a premium delayed coking unit are well known in the art, and do not constitute a part of this invention. The conventional conditions for making delayed premium coke comprise introducing a premium coke feedstock to a coker furnace where it is heated to coking temperature, generally from 425°-540° C., followed by introduction of the heated feedstock to a delayed coking drum maintained at typical premium coking conditions of from 440°-470° C. and 0.5 to 7 kg/cm$^2$. The procedure for making a graphitized electrode from premium coke is also well known in the art and does not constitute a part of this invention.

Another process which is available in the art for upgrading heavy, low value petroleum residual oils is hydrogen donor diluent cracking (HDDC). In this process, a hydrogen-deficient oil such as vacuum residuum is upgraded by admixing it with a relatively inexpensive hydrogen donor diluent material and thermally cracking the resulting mixture. The donor diluent is preferably an aromatic-napthenic material having the ability to take up hydrogen in a hydrogenation zone and to readily release it to hydrogen-deficient hydrocarbons in a thermal cracking zone. The selected donor material is partially hydrogenated by conventional methods, using, for example, a sulfur-insensitive catalyst such a molybdenum sulfide, nickel-molybdenum or nickel-tungsten sulfide. Details of the HDDC process are described in U.S. Pat. Nos. 2,953,513 and 3,238,118. A process for producing premium coke from vacuum residuum in which the vacuum residuum is subjected to a hydrogen donor diluent cracking process and the pitch from the cracking step utilized as feedstock to a delayed premium coker is described in Application Ser. No. 908,333 filed May 22, 1978.

Catalytic desulfurization of high sulfur petroleum streams is well known, and is widely practiced in the petroleum refining art. Examples of processes utilizing catalytic desulfurization of petroleum streams are described in U.S. Pat. Nos. 2,703,780 and 2,772,221. The latter patent describes a process wherein resid is subjected to hydrogen donor diluent cracking, and a portion of the products from the cracking step is subjected to hydrogenation and subsequently used as recycle donor diluent. The conditions required to obtain a desired degree of hydrogenation are easily determined by those skilled in the art.

Prior to this invention, there has been no satisfactory process available which could produce a premium coke from a high sulfur vacuum residuum.

SUMMARY OF THE INVENTION

According to the present invention, a petroleum vacuum residuum stream is subjected to hydrogen donor diluent cracking, the effluent from the cracking step is passed to a flash separator, and the liquid fraction is hydrodesulfurized. The hydrodesulfurizer effluent is fractionated, and the fractionator bottoms stream is fed to a delayed coker operated at premium coking conditions where premium type delayed coke is produced. The gas-oil boiling range fraction from the fractionator, which has been hydrogenated in the hydrodesulfurizer prior to fractionation, is utilized as the donor diluent in the cracking step.

This invention enables the production of premium coke, along with various distillates and lightends, from a high sulfur vacuum residuum. Previously, such materials could not be utilized as feedstock for a premium delayed coker, or at best could only be blended in small amounts with a conventional premium coker feed. The process of the invention differs from the prior art in that the entire liquid effluent from the donor diluent cracking step is subjected to catalytic desulfurization. The effluent from the desulfurizing step is fractionated and a gas-oil boiling range stream from the fractionator is utilized as the donor-diluent stream to the cracking step. The bottoms fraction from the fractionator is utilized as feed for a premium delayed coker.

DESCRIPTION OF THE DRAWING

The drawing is a schematic flow sheet illustrating the process of the invention.

DESCRIPTION OF THE PREFERRED EMBODIMENT

Figure 1:
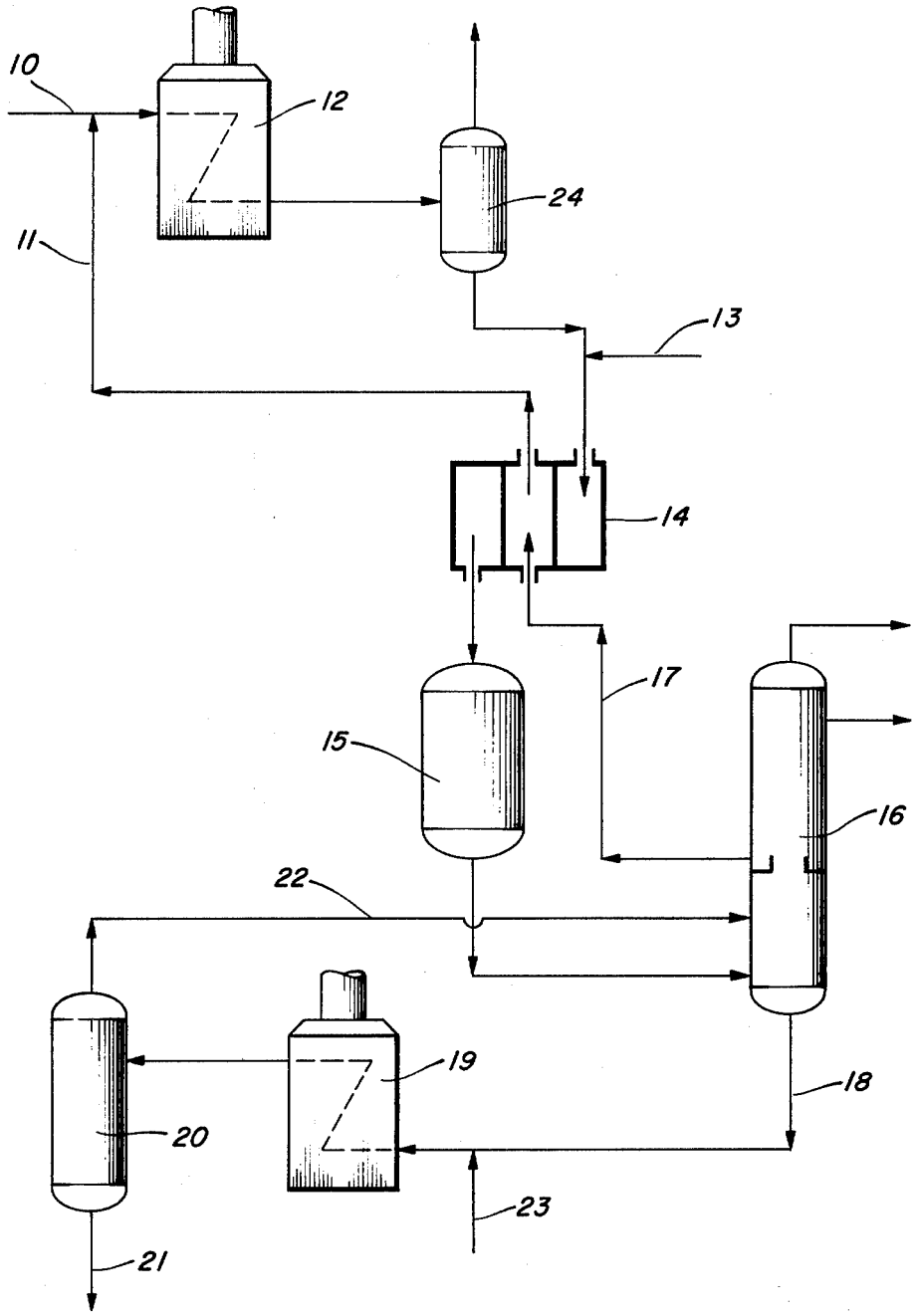

The process of the invention will be described with reference to the drawing. Vacuum residuum in line 10 is combined with hydrogen donor diluent from line 11 and fed to cracking furnace 12. The cracked effluent from furnace 12 goes to flash drum 24 and the flash drum liquid is combined with hydrogen from line 13, and after passing through heat exchanger 14 is fed to catalytic desulfurizer 15. The desulfurized effluent from desulfurizer 15 is fed to fractionator 16, and various product streams are withdrawn. A stream in the gas-oil boiling range is withdrawn from fractionator 16 through line 17, passed through heat exchanger 14, and subsequently utilized as donor diluent in cracking furnace 12. The bottoms fraction from fractionator 16 is withdrawn through line 18 and passed to premium coker furnace 19 where it is heated to coking temperature and fed to delayed premium coker 20. Premium coke is withdrawn through outlet 21, and volatile overhead vapors are withdrawn through line 22 and returned to fractionator 16.

This process involves passing the entire liquid effluent from cracking furnace 12 through catalytic desulfurizer 15 such that all of the products from fractionator 16 have been subjected to desulfurization and accordingly are low sulfur products. In addition, the catalytic desulfurization serves to partially hydrogenate the gas-oil boiling range material passing therethrough such that it can be taken off from fractionator 16 and recycled back to the cracking furnace for use as a source of hydrogen in the hydrogen donor diluent cracking operation.

In a particularly preferred embodiment, the resid has a specific gravity of from 0.95 to 1.15 and 80 volume percent or more of the resid boils above 480° C., and the fractionator is operated in a manner to provide a bottoms fraction having at least 40 and up to as much as 90 volume percent material boiling in the 370°-510 ° C. range.

The process of this invention is particularly valuable when the vacuum residuum feedstock to the donor cracking step has a high sulfur content, such as greater than one percent by weight. The catalytic desulfurizer reduces the sulfur level of the cracked products to an acceptable level, and simultaneously restores the hydrogen donor capability of the donor diluent which is then recycled back to the donor cracking furnace.

The conditions in the donor cracking step are generally those as described in the aforementioned U.S. Pat. No. 2,953,513 to Langer et al, but preferably the conditions include a relatively high cracking temperature such as from 490°-540° C. and a relatively short residence time such as from 2-6 minutes.

The hydrodesulfurization conditions preferably range from relatively mild to moderate.

The conditions in the premium coking operation are typical for a delayed premium coker, and in some cases it may be desirable to blend a conventional premium coker feedstock such as thermal tar, decant oil or pyrolysis tar through line 23. A typical commercial operation utilizing the process of the invention is described in detail in the following example.

EXAMPLE 1

A 1.01 specific gravity vacuum resid, containing 3.2 weight percent sulfur, obtained from distillation of a Persian Gulf crude oil is donor cracked at cracking coil conditions of 510° C., 28 kg/cm$^2$ and a residence time of 4 minutes.

The coil effluent is flashed and the liquid fraction hydrotreated over a nickel/molybdenum sulfide catalyst at 390° C., 84 kg/cm$^2$ and with a liquid hourly space velocity (LHSV) of 0.25 hr$^{-1}$.

The hydrotreater effluent is fractionated. Part of the 315°-480° C. fraction is recycled to the donor cracker and the fractionator bottoms including 70 volume percent material boiling in the 370°-510° C. range are then processed to coke in a delayed coker operating at 2.5 kg/cm$^2$ pressure and a coke drum temperature of 440°-470° C.

The product coke has a sulfur content of less than 1 weight percent, a density of 2.1 g/cc and a CTE of less than $5\times10^{-7}$/°C.

What is claimed is:

1. A process for making premium delayed coke from a petroleum refinery vacuum residuum feedstock comprising:

(a) subjecting said feedstock to a hydrogen donor diluent cracking step;

(b) subjecting the effluent from the cracking step to a flash separation;

(c) subjecting the liquid effluent from said flash separation to a catalytic hydrodesulfurization step;

(d) fractionating the effluent from said hydrodesulfurization step to produce light ends, distillates, a hydrogen donor diluent stream and a bottoms stream;

(e) utilizing said hydrogen donor diluent stream as the hydrogen donor diluent in step (a); and (f) subjecting said bottoms stream to a delayed coking process conducted at premium coking conditions and recovering premium delayed coke.

2. The process of claim 1 wherein said feedstock has a sulfur content greater than one percent by weight.

3. The process of claim 1 wherein said feedstock has a specific gravity between 0.95 and 1.15, and at least 80 volume percent of the feedstock boils above 480° C.

4. The process of claim 3 wherein said bottoms stream has from 40 to 90 volume percent material boiling in the 370°-510° C. range.

* * * * *